US005479187A

United States Patent [19]

Chen

[11] Patent Number: 5,479,187

[45] Date of Patent: Dec. 26, 1995

[54] VERTICALLY SCANNED NARROW LIGHT BEAM SOURCE FOR LCD DISPLAY

[75] Inventor: Hsing-Yao Chen, Barrington, Ill.

[73] Assignee: Chunghwa Picture Tubes, Ltd., Taoyuan, Taiwan

[21] Appl. No.: 200,345

[22] Filed: Feb. 23, 1994

[51] Int. Cl.[6] ..... G09G 3/36

[52] U.S. Cl. ..... 345/102; 359/49; 345/32

[58] Field of Search ..... 345/102, 32, 110; 359/49, 48, 50; 348/766; 340/815.68

[56] References Cited

U.S. PATENT DOCUMENTS

| | | | |
|---|---|---|---|
| 4,487,481 | 12/1984 | Suzawa | 345/102 |
| 4,951,150 | 8/1990 | Browning . | |
| 4,978,952 | 12/1990 | Irwin | 345/102 |
| 4,995,273 | 2/1991 | Kisima et al. . | |
| 5,089,883 | 2/1992 | Welker et al. . | |
| 5,103,328 | 4/1992 | Numao | 359/48 |
| 5,128,782 | 7/1992 | Wood . | |
| 5,135,300 | 8/1992 | Toide et al. . | |
| 5,140,449 | 8/1992 | Sluzky et al. . | |
| 5,142,388 | 8/1992 | Watanabe et al. . | |
| 5,144,471 | 9/1992 | Takanashi et al. . | |
| 5,146,354 | 9/1992 | Plesinger et al. . | |
| 5,146,355 | 9/1992 | Prince et al. . | |
| 5,162,786 | 11/1992 | Fukuda . | |
| 5,162,930 | 11/1992 | Sluzky et al. . | |
| 5,175,637 | 12/1992 | Jones et al. | 359/48 |
| 5,214,521 | 5/1993 | Kwon et al. . | |
| 5,227,769 | 7/1993 | Leksell et al. . | |

FOREIGN PATENT DOCUMENTS

| | | | |
|---|---|---|---|
| 63-241525 | 10/1988 | Japan | 345/102 |

*Primary Examiner*—Richard Hjerpe
*Assistant Examiner*—Regina Liang
*Attorney, Agent, or Firm*—Emrich & Dithmar

[57] ABSTRACT

A video display system includes a passive display panel such as a liquid crystal display (LCD) panel including a first plurality of horizontally aligned transparent conductive scanning electrodes and a second plurality of vertically aligned transparent conductive signal electrodes disposed on opposed surfaces of the panel. Light directed onto the aft surface of the display panel is transmitted through the panel as each horizontal linear array of first scanning electrodes is turned "ON" with the horizontal linear arrays sequentially turned on for vertically scanning the display panel in a step wise manner. Video image information is provided to the vertically aligned electrodes. Liquid crystal display backlighting is provided by an elongated, linear lamp disposed within a first concave reflector for directing the beam onto a second reflector which reflects the beam onto the display panel's aft surface in the form of a thin, elongated line extending the width of the display panel. The second reflector displaces the beam over the display panel in the disclosed embodiment from top to bottom synchronously with scanning of the horizontally aligned scanning electrodes in the panel such that the beam illuminates only the horizontal linear array of the scanning electrodes which is turned "ON", i.e. only that portion of the display panel containing video information, for improved video image contrast and more efficient backlighting of the display panel.

13 Claims, 5 Drawing Sheets

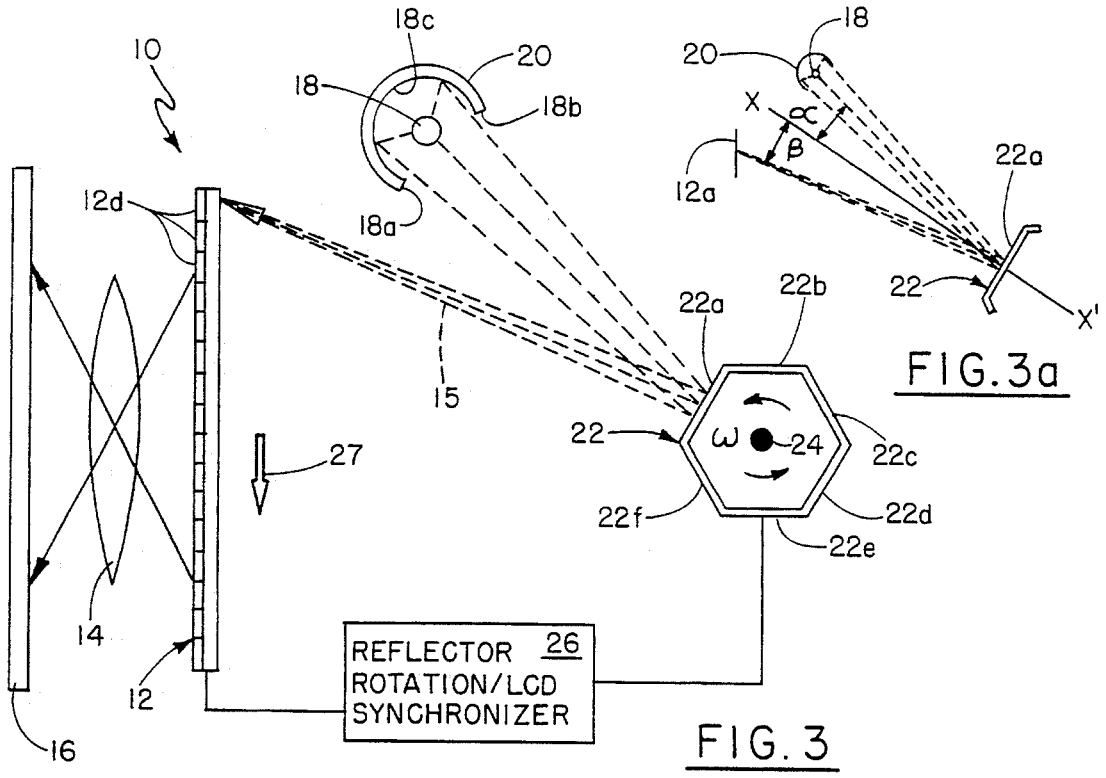
FIG. 3a
FIG. 3
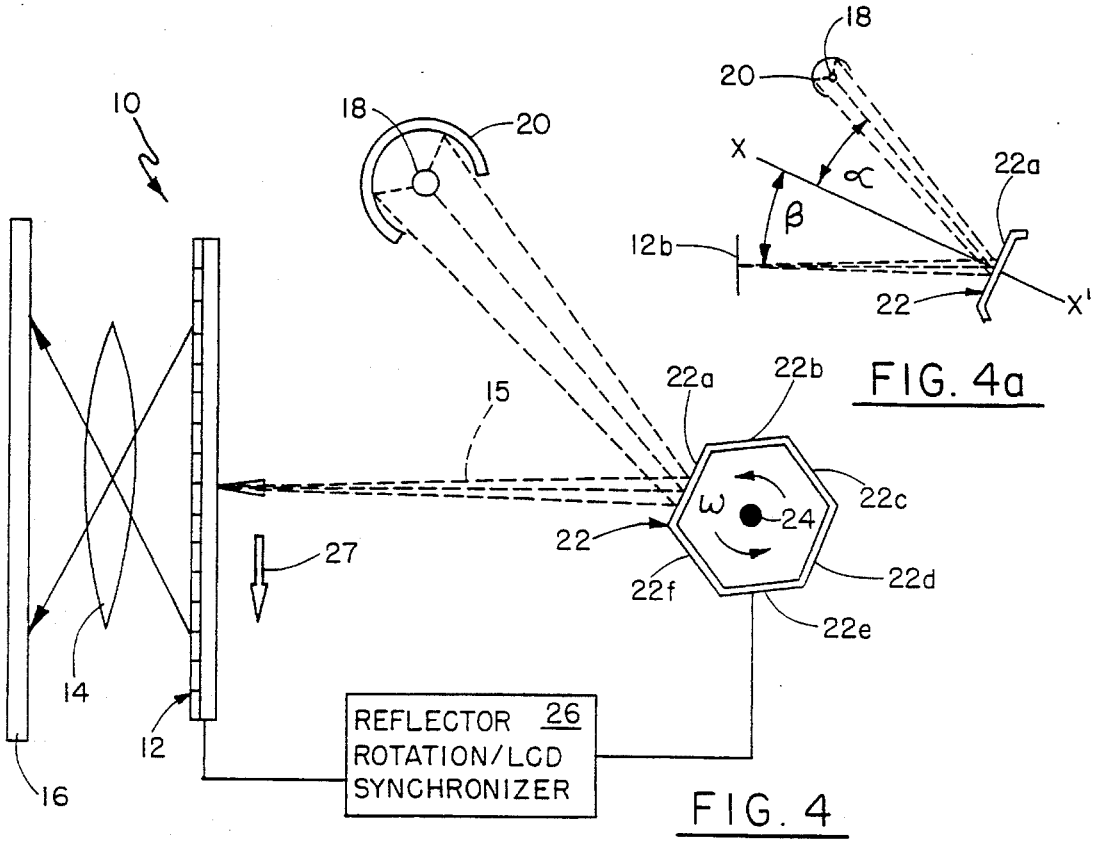
FIG. 4a
FIG. 4

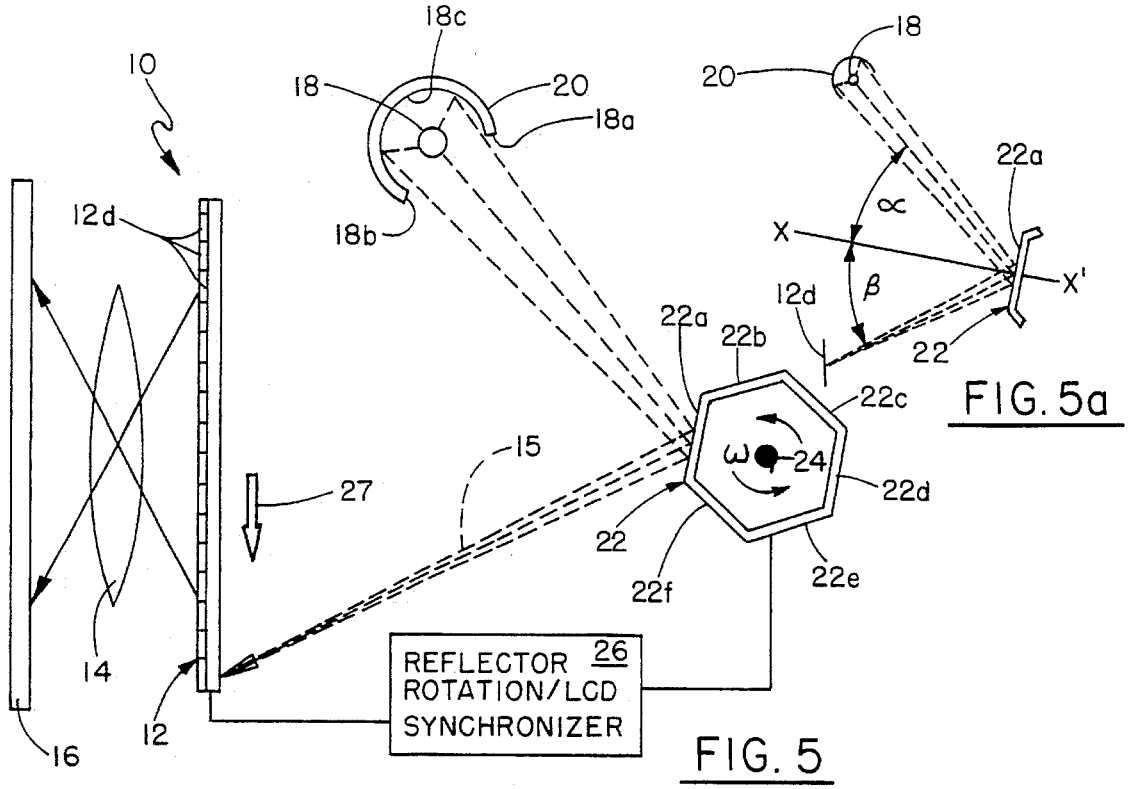
FIG. 5a
FIG. 5
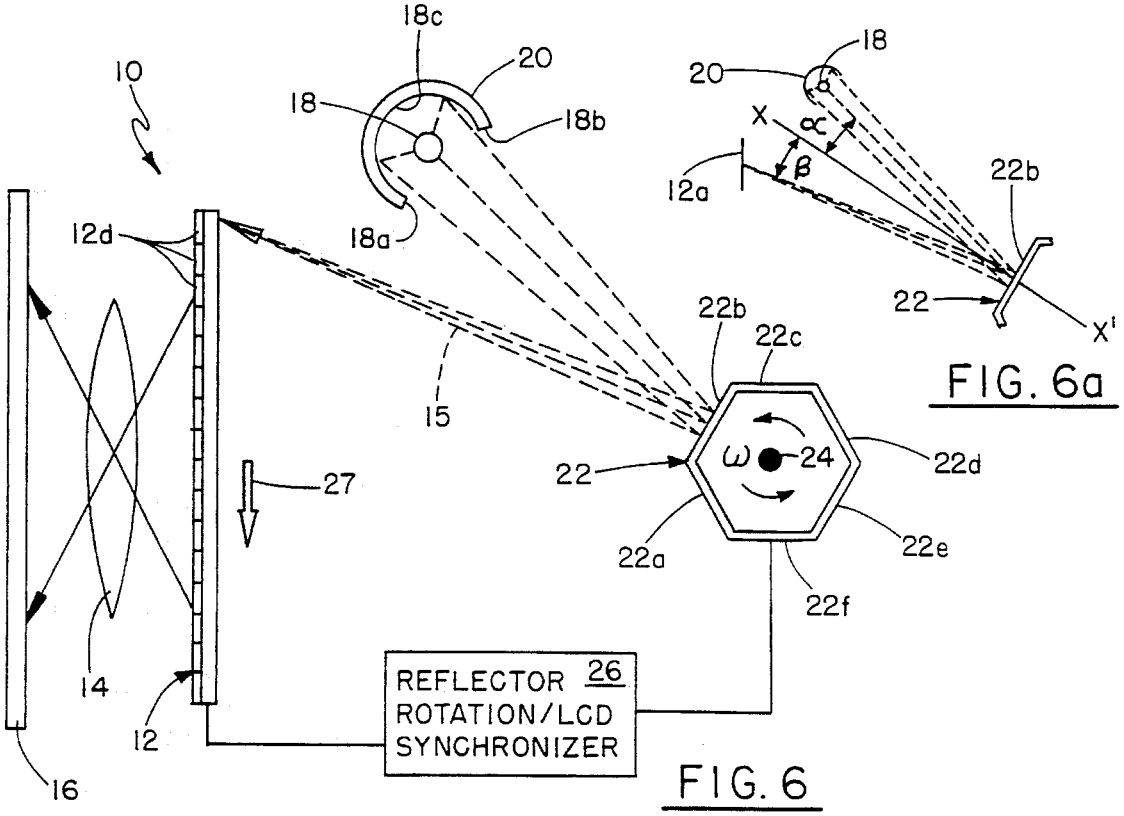
FIG. 6a
FIG. 6

VERTICALLY SCANNED NARROW LIGHT BEAM SOURCE FOR LCD DISPLAY

FIELD OF THE INVENTION

This invention relates generally to projection liquid crystal displays (LCDs) such as used in television receivers and computer terminals and is particularly directed to a backlighting arrangement for an LCD display which provides improved video image contrast and more efficient display backlighting.

BACKGROUND OF THE INVENTION

A liquid crystal display (LCD) is a passive type of display for providing a video image. LCDs are commonly used in television receivers, portable computer displays, and other electronic devices. An LCD usually requires a source of back light for operation because the LCD operates effectively as a light valve (thus it is referred to as a "passive" display device), allowing transmission of light in one state and blocking transmission of light in a second state. The typical LCD panel structure includes a liquid crystal polymer encapsulated between at least two planar glass plates in parallel with each other. A polarization layer is bonded to the outer surface of each glass plate such that the glass plates are sandwiched between two polarization layers.

The inner surface, or the surface facing the liquid crystal polymer, of each glass plate includes mutually perpendicularly oriented, conductive, transparent linear arrays of electrodes. The volume of the liquid crystal polymer between any two orthogonal arrays of electrodes forms a cube whose face area constitutes a pixel. The electrode arrays are connected on the periphery of the glass plates via input/output (I/O) strips for coupling to electronic circuitry for applying a voltage to the two sets of orthogonal conductive transparent electrode arrays. To one set of linear, parallel arrays of electrodes is provided video image information (typically to the vertically aligned electrodes), while to the other linear, parallel array of electrodes (typically the array oriented horizontally) are provided "ON" signals in a sequential manner such that each horizontal linear array of electrodes is sequentially turned on rendering the portion of the liquid crystal polymer under the turned-on electrode array transparent for presenting a portion of the video image. The vertically aligned electrodes are known as "signal" electrodes, while the horizontally aligned electrodes are commonly referred to as "scanning" electrodes.

The liquid crystal polymer is disposed intermediate first and second transparent electrodes. A voltage source couples the first and second transparent electrodes via a switch. Without a voltage applied across the liquid crystal polymer, the liquid crystal molecules are randomly oriented and incident light is randomly scattered by the liquid crystal polymer. With the switch closed and a voltage applied across the liquid crystal polymer, the liquid crystal molecules become optically aligned with the polarizer and render the "ON" line transparent. Thus, light incident upon this line is transmitted therethrough. In a conventional LCD display, a light source is placed behind the LCD panel to illuminate the whole panel and project a video image. The light source may be a fluorescent discharge tube or a metal halide or Xenon arc lamp. At any instant during operation, the LCD panel has only one horizontal line "ON," with only this line allowing for transmission of light through the panel. Facing electrodes adjacent all other horizontal lines in the LCD panel are OFF. Therefore, most of the light from the light source aft of the panel is blocked by the non-transmitting portions of the LCD panel and converted to heat. This arrangement is characterized by low light utilization efficiency and the generation of a substantial amount of heat which must be dissipated. Also, some of the light in the non-transmitting line areas is transmitted through the LCD panel by scattering which causes loss of contrast. In a standard NTSC system with 525 horizontal scan lines in a conventional projection LCD system, it can be seen that with only 1/525th of the input light utilized for producing a useful image, much energy is wasted in a conventional projection LCD system. This waste will increase in future systems employing high definition television (HDTV) displays which employ over 1000 horizontal scan lines and which will reduce light utilization efficiency even further. In order to increase image brightness and contrast, more powerful light sources are being developed. These more powerful light sources providing more lumens with more watts of power will produce even more heat and make component cooling and heat dissipation even more important design considerations.

This invention addresses the aforementioned limitations of the prior art by providing a backlighting source for an LCD panel which brightly illuminates only that portion of the LCD panel rendered transparent and containing video information and which maintains the backlighting beam on the transparent portion as it scans the display panel.

OBJECTS AND SUMMARY OF THE INVENTION

Accordingly, it is an object of the present invention to provide improved and more efficient backlighting for an LCD panel.

It is another object of the present invention to provide backlighting for only that portion of an LCD panel which is turned "ON" for more efficient video image backlighting and minimizing of back light scattering by the display panel.

Yet another object of the present invention is to provide improved contrast and brightness in a back lighted LCD panel by illuminating only that portion of the panel upon which video information is presented.

A further object of the present invention is to reduce the heat generated in backlighting an LCD panel particularly in a projection LCD display.

These objects of the present invention are achieved and the disadvantages of the prior art are avoided by a video display apparatus comprising a passive, generally planar display panel having a plurality of linear, spaced, parallel arrays of video image elements, wherein the arrays of video image elements are vertically scanned in a sequential manner from a first edge of the panel to a second, opposed edge of the panel in providing a plurality of spaced, parallel portions of a video image in a sequential manner on the display panel; an elongated, generally linear light source for providing an elongated, linear focused light beam having uniform intensity along the length thereof; reflecting means for receiving and directing the light beam onto the display panel in a scanning manner wherein the light beam traverses the display panel from the first edge to the second edge thereof; and synchronizing drive means coupled to the display panel and to the reflecting means for displacing the light beam across the display panel in synchronism with the vertical scanning of the arrays of video image elements in the display panel in providing a video image on the display panel.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 3 is a simplified combined block and schematic diagram of a projection LCD display system incorporating a backlighting arrangement in accordance with the present invention;

FIG. 3*a* is an enlarged view of a portion of the projection LCD display system of FIG. 3 illustrating additional details of the inventive backlighting arrangement;

FIGS. 4 and 4*a*, 5 and 5*a*, and 6 and 6*a* are combined schematic and block diagrams of the projection LCD display system and backlighting arrangement of FIG. 3 illustrating displacement of a light beam on the aft surface of the LCD panel in accordance with the present invention;

DETAILED DESCRIPTION OF THE PREFERRED EMBODIMENTS

Figure 1:
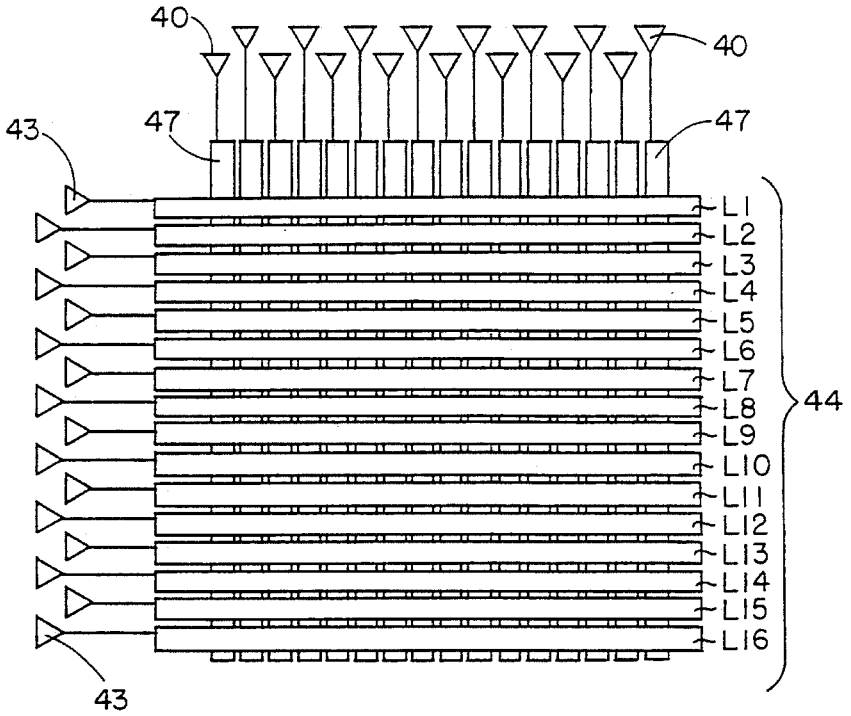
FIG. 1 is a schematic front elevation view of an LCD panel for use with the backlighting arrangement of the present invention.
Figure 2:
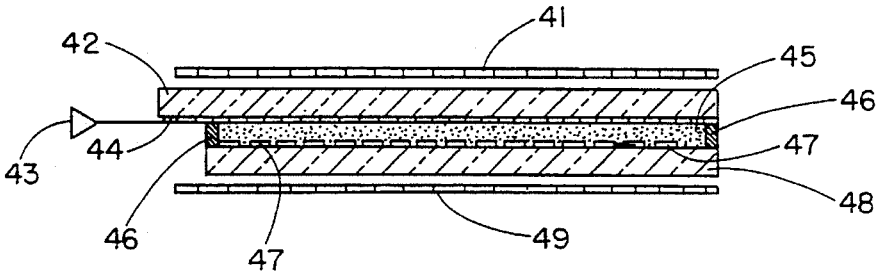
FIG. 2 is a schematic longitudinal cross-sectional view of the LCD panel shown in FIG. 1.

Referring to FIGS. 1 and 2, there are respectively shown schematic top plan and longitudinal cross-sectional views of a liquid crystal display device with which the backlighting source of the present invention is intended for use. Sixteen transparent conductive scanning electrodes 44 ($L_1$ to $L_{16}$) having a strip shape are formed in parallel with each other on the inner surface of a transparent substrate 42, and sixteen transparent conductive signal electrodes 47 for applying a video signal having a strip shape are formed in parallel with each other on the inner surface of a transparent substrate 48. A ferroelectric liquid crystal layer 45 is formed between the transparent substrates 42 and 48 and is sealed by a sealing element 46. Respective drivers 43 are connected to the respective electrodes 44 ($L_1$ to $L_{16}$) so as to apply a voltage $V_C$ thereto. Respective drivers 40 are connected to the respective signal electrodes 47 so as to apply voltages $V_S$ thereto. Polarizers 41 and 49 arranged to have a crossed Nicols relation are disposed oppositely to each other, and the backlighting source of the present invention is located adjacent the outer surface of polarizer 49, although this is not shown in the figure for simplicity. Although the liquid crystal display device is shown as having sixteen transparent conductive scanning electrodes 44, it is not limited to this arrangement of scanning and may include virtually any member of scanning electrode arrays.

Portions where the respective electrodes 44 and electrodes 47 overlap form picture elements. Voltages $V_C$ and $V_S$ are applied to corresponding electrodes 44 and 47 so as to bring a picture element formed by one of the signal electrodes 47 to a bright state. In this matrix type display panel, a voltage is sequentially applied to each of the scanning electrodes 44 in typically proceeding downward along the liquid crystal layer 45. As the voltage is sequentially applied to each of the scanning electrodes 44, the portion of the video image under the scanning electrode to which the voltage is applied is visible on the liquid crystal layer 45. A set of video image voltages are simultaneously applied to each of the vertically aligned signal electrodes 47 such that the video image presented on the liquid crystal layer 45 appears uniform and continuous.

Referring to FIG. 3, there is shown in combined, simplified schematic and block diagram form a projection LCD display system 10 incorporating a backlighting arrangement in accordance with the present invention. The backlighting arrangement of the present invention includes an elongated, linear light source 18 disposed within a concave light focusing element 20. Light source 18 may be comprised of a conventional high intensity light source such as a Xenon arc lamp or a metal halide lamp. Light source 18 is characterized as emitting light of uniform intensity along its entire length and in an omni-directional manner. Light focusing element 20 is shown as having a partial circular cross section and including an open slot defined by edges 18*a* and 18*b*. Light focusing element 20 further includes an inner reflecting surface 18*c* for forming light emitted by light source 18 into a narrow, focused beam 15 (shown in dotted line form) extending the length of a light source. The present invention is not limited to a generally circular shaped light focusing element 20 as shown in FIG. 3, but may employ a light focusing member of virtually any concave shape for forming the light into a focused beam.

The light emitted by the combination of light source 18 and light focusing element 20 is initially directed onto a multifaceted rotating reflector 22. In the embodiment illustrated, reflector 22 includes six outer reflecting surfaces 22*a*–22*f*. As shown in FIG. 3, as well as in FIG. 3*a* which is an enlarged view of a portion of FIG. 3, light emitted by the combination of light source 18 and light focusing element 20 is directed onto reflecting surface 22*a* of the multi-faceted rotating reflector 22. Each of the reflecting surfaces 22*a*–22*f* is generally planar such that the angle of incidence $\alpha$ is equal to the angle of reflection $\beta$, where the angles $\alpha$ and $\beta$ are measured from a line X—X' perpendicular to reflecting surface 22*a* at the point of incidence of the light beam. Reflector 22 is rotated in a counterclockwise direction as shown in FIG. 3 about an axis 24 at an angular velocity of $\Omega$. The light beam 15 is directed by the outer reflecting surface 22*a* onto an upper portion of a generally planar LCD panel 12 which includes a plurality of spaced, elongated, horizontally aligned, transparent conductive scanning electrodes 12*d*. Those conductive scanning electrodes 12*d* which are rendered conductive, and thus transparent, and upon which the light beam is incident form a portion of a video image which is projected out of a forward surface of the LCD 12 and onto a projection screen 16. A focusing lens 14 is disposed intermediate LCD panel 12 and projection screen 16 for focusing a video image on the projection screen.

A reflector rotation/LCD synchronizer 26 is coupled to LCD panel 12 and to rotating reflector 22. Reflector rotation/LCD synchronizer 26 provides input signals to the LCD panel 12 for sequentially actuating each of the horizontally aligned arrays of transparent conductive scanning electrodes 12*d* rendering that particular portion of the LCD panel transparent to light and thus capable of providing a portion of a video image on a forward surface of the LCD panel. In this respect, reflector rotation/LCD synchronizer 26, in driving LCD panel 12, may be conventional in design and operation as this is the typical manner in which portions of an LCD panel are rendered transparent for presenting a video image as the LCD panel is scanned by a backlighting source.

Reflector rotation/LCD synchronizer 26 is further coupled to multi-faceted reflector 22 for rotationally displacing the reflector in a counterclockwise direction at an angular velocity of $\Omega$ for synchronizing scanning of the LCD panel by the reflected light beam 15 with the sequential scanning of the panel's transparent conductive scanning electrodes 12*d*. Thus, with the transparent conductive scanning electrodes 12*d* sequentially scanned downward in the direction of arrow 27, counterclockwise rotation of the multi-faceted reflector 22 results in downward scanning of the LCD panel 12 by the light beam 15 in a synchronized manner. Thus, that portion of the LCD panel 12 rendered transparent by actuation of the horizontally aligned scanning electrodes 12*d* is the only portion of the LCD panel illuminated by light beam 15 with the light beam displaced downward along the LCD panel in a coincident manner with the downward, sequential movement of the scanning electrodes rendered conductive and thus transparent. Other portions of the LCD panel 12 which are not transparent and thus do not contain video image information do not receive any light and thus do not contribute to background brightness resulting in improved video image contrast. In addition, with only a small portion of the LCD panel 12 illuminated at a given time, more efficient use is made of the incident light beam 15 resulting in less heat generation and a brighter video image for a fraction of given light source output. As shown in FIG. 3*a*, an upper edge portion 12*a* of LCD panel 12 is illuminated by the reflected beam 15 with the rotating reflector 22, and in particular its reflecting surface 22*a*, in the orientation shown in the figure.

As reflector 22 continues to rotate in a counterclockwise direction as shown in FIG. 4, the beam is directed onto an intermediate portion of the LCD panel 12. An enlarged view of the backlighting arrangement with the rotating reflector 22 in the orientation shown in FIG. 4 is illustrated in FIG. 4*a*, which shows the light beam incident upon intermediate portion 12*b* of the LCD panel 12. Again, the angle of incidence $\alpha$ is equal to the angle of reflection $\beta$, where both angles are measured from a line X—X' perpendicular to reflecting surface 22*a* at the point of incidence of the light beam. In order to simplify the illustrations, the illumination of the light beam of those portions of the LCD panel 12 disposed intermediate the upper edge portion 12*a* of FIG. 3*a* and the intermediate portion 12*b* of FIG. 4*a* are not shown.

As the conductive scanning electrodes 12*d* of the LCD panel 12 are sequentially actuated and rendered transparent in moving downward on the LCD panel, continued rotation of reflector 22 causes further angular displacement of the light beam in the direction of arrow 27 until it illuminates a lower edge portion 12*b* of the LCD panel as shown in FIGS. 5 and 5*a*. Here, the angles of incidence and reflection, $\alpha$ and $\beta$, are still equal, but are much larger than the angles for the previously described orientations of the rotating reflector 22. As reflector 22 continues to rotate in a counterclockwise direction, light beam 15 will be displaced downward from the lower edge portion 12*c* of the LCD panel 12 such that it is no longer incident on the inner surface of the panel. At this point in time, or shortly thereafter, the next reflecting surface 22*b* of rotating reflector 22 is in position to receive the light beam 15 and direct it onto the upper edge portion 12*a* of the LCD panel 12 as shown in FIGS. 6 and 6*a*. Thus, each of the reflecting surfaces 20*a*–22*f* sequentially directs the light beam 15 onto the inner surface of the LCD panel 12 and displaces the light beam downward over the panel synchronously with the scanning of the conductive electrodes 12*d* in the panel. In this manner, light beam 15 is directed only upon those conductive scanning electrodes 12*d* in the linear array of electrodes which are transparent at any given time.

Figure 3B:
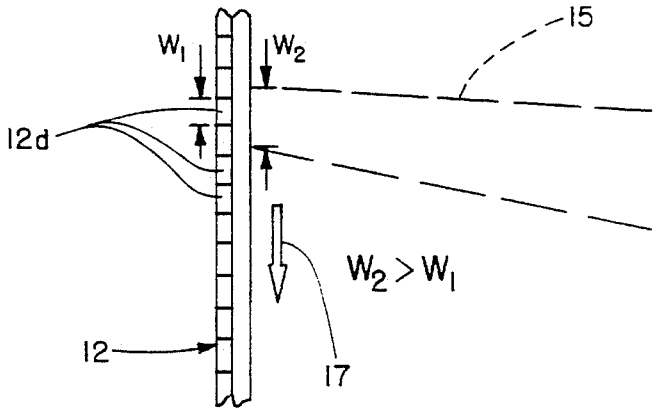
FIG. 3*b* is a simplified side elevation view of a thin, elongated light beam incident upon the aft, or inner, surface of an LCD panel having a plurality of horizontally aligned vertically spaced conductive scanning electrodes.

Referring to FIG. 3*b*, there is shown a simplified side elevation view of light beam 15 incident upon LCD panel 12 which includes a plurality of horizontally aligned, vertically spaced scanning electrodes 12*d* which, when rendered conductive, become transparent to light incident thereon. As shown in the figure, each of the scanning electrodes 12*d* has a vertical height $W_1$. Also as shown in the figure, the incident light beam 15 is focused to a smaller vertical dimension than its height at a position displaced from the LCD panel 12 and has a vertical height of $W_2$ at the LCD panel 12. As light beam 15 is scanned downwardly in the direction of arrow 17, the reflector rotation/LCD synchronizer described above angularly displaces the beam 15 downwardly in the vertical direction so that it is incident upon the selected horizontal array of scanning electrodes 12*d* rendered conductive and thus transparent at that time. With $W_2>W_1$, light beam 15 is more easily maintained incident upon the conductive scanning electrodes 12*d* which are rendered transparent in a sequential, downwardly directed manner. Providing $W_2$ with a greater dimension than $W_1$ also allows for non-uniformities in the linear scanning speed of the beam 15 over LCD panel 12 as the beam is rotationally displaced at an angular velocity $\Omega$ and is incident upon the generally flat, aft surface of the LCD panel 12. This allows for greater mechanical tolerance in the angular displacement of the light beam 15 and in the scanning of the LCD panel by electrodes 12*d*. Thus, while a portion of the light beam 15 extends beyond the upper and lower limits of each array of scanning electrodes 12*d* and thus does not contribute to backlighting of the scanning electrodes, it is only a small portion of the beam which does not contribute directly to backlighting of the LCD panel. A substantial portion of the light beam is incident upon each linear array of scanning electrodes rendered transparent for more efficient use of the source of LCD panel backlighting and for improved video image brightness. Although the light beam 15 is shown in FIG. 3*b* as having a greater vertical dimension $W_2$ than that of a horizontal scan line $W_1$, this invention is not limited to this arrangement but also contemplates the beam and horizontal scan lines as having the same vertical dimensions as well as the horizontal scan lines having a greater vertical width than that of the light beam. The inventive backlighting arrangement will operate equally as well in any of these arrangements.

Figure 9:
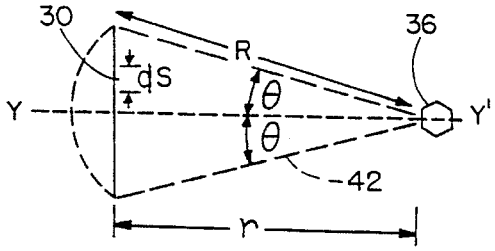
FIG. 9 is a simplified schematic diagram illustrating the relative position and orientation of the rotating reflector portion of the backlighting arrangement relative to the LCD panel.

Due to the fact that the multi-faceted rotating reflector 22 angularly displaces the light beam 15 and directs it onto the planar LCD panel 12, the linear velocity of the beam across the panel varies between the lower and upper edges of the panel. This can be explained with respect to FIG. 9 which is a simplified geometric diagram illustrating the relative positions of the rotating reflector 36, scanning light beam 42, and LCD panel 30. As shown in the figure, the angle that light beam 15 makes with the axis Y—Y' perpendicular to the LCD panel 12 is given by the angle Θ. The distance from rotating reflector 36 to LCD panel 30 along the axis Y—Y' perpendicular to the LCD panel is given by the value r, while the distance between the rotating reflector and either an upper or lower edge of the LCD panel is given by the value R. The vertical distance along the LCD panel 12 moved by beam 15 during the time interval dt is given by the value dS. A change in the position of the beam 15 on the LCD panel 12 in terms of a change in the angle Θ is given by the following:

$$ds \approx R d\Theta \qquad \text{[EQ. 1]}$$

The relationship between the perpendicular distance r and the radial distance from rotating reflector 36 to LCD panel 12 is given by the following:

$$r = R \cos \Theta \qquad \text{[EQ. 2]}$$

which leads to $$R = \frac{r}{\cos\Theta} \qquad \text{[EQ. 3]}$$

The scan rate, or velocity, of light beam 15 over the LCD panel 12 is given by the following:

$$v = \frac{dS}{dt} = \frac{Rd\Theta}{dt} = \frac{r}{\cos\Theta}\,\omega \qquad \text{[EQ. 4]}$$

where

ω=the angular velocity of the light beam.

It can be seen from Equation 4 that the velocity of the light beam 15 as it sweeps over the flat LCD panel 30 changes in magnitude, being greatest at the upper and lower edges of the panel where the angle Θ is maximum and minimum along the perpendicular axis Y—Y' to the LCD panel. To accommodate this change in the rate at which the light moves over the LCD panel, the beam angular velocity ω may be modified during scanning. In addition, the surfaces of the rotating reflector 36 may be contoured (non-planar) to compensate for this non-linear scanning rate. The extent of change in light beam angular velocity may be easily determined by conventional calculations based upon system geometry, optics and LCD panel operation.

Figure 7:
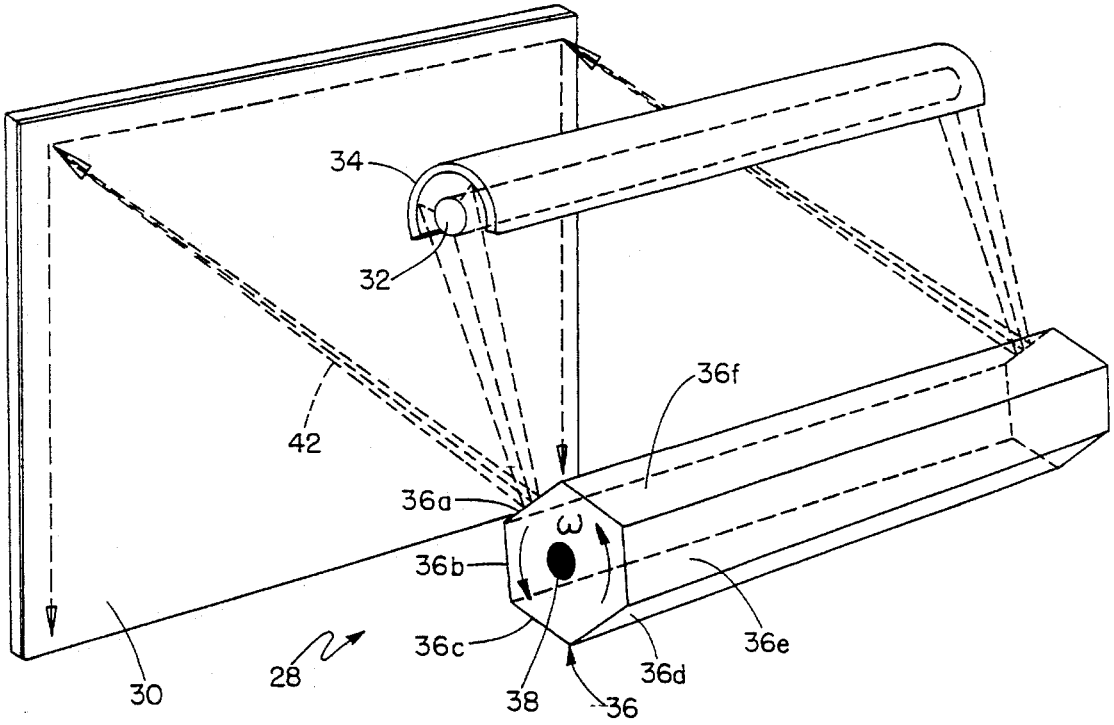
FIG. 7 is a simplified perspective view of the backlighting arrangement for directing a vertically scanned narrow light beam on the aft surface of an LCD panel in accordance with the present invention.
Figure 8:
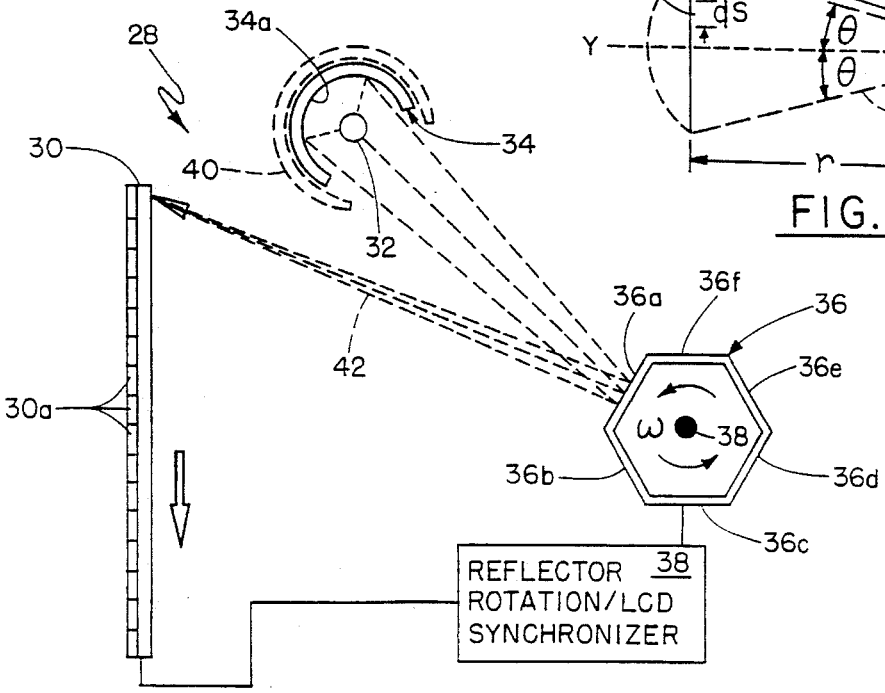
FIG. 8 is a combined simplified schematic and block diagram of an LCD backlighting arrangement as shown in FIG. 7.

The LCD display thus far described and illustrated is disclosed in terms of a projection display system. The vertically scanned narrow light beam source of the present invention is not limited to use in a projection LCD display system, but can be used for backlighting a non-projection type LCD display. This is shown in the perspective and side elevation views of FIGS. 7 and 8, respectively, where the backlighting arrangement of the present invention is shown as directing a light beam 42 on an aft surface of an LCD display 30 which is not employed in a projection display system.

As in the previous embodiment, an elongated, linear light source 32 emits light omni-directionally. Disposed substantially about the light source 32 is a generally circular light focusing element 34 having an inner concave reflecting surface **34*a* which directs a focused light beam 42 onto a multi-faceted rotating reflector 36 through a linear, elongated slot in the reflector. The light beam is then directed upon the aft surface of a planar LCD panel 30 upon which the light beam is focused. Reflector 36 rotates in a counterclockwise direction at an angular velocity ω for sweeping the light beam over the LCD panel 30 in a downward direction. The multi-faceted rotating reflector 36 includes a plurality of outer, planar reflecting surfaces 36*a* -36f which each, in sequence, reflect the light beam 42 onto the LCD panel 30 in a downward scanning manner. Reflector 36 is rotated about an axis 38 which is generally parallel to the plane of LCD panel 30. As in the previous embodiment, a reflector rotation/LCD synchronizer 38 performs two operations simultaneously. The reflector rotation/LCD synchronizer 38 sequentially actuates each horizontal array of conductive scanning electrodes 30*a* for rendering the electrodes transparent to light while rotationally displacing reflector 36 in a counterclockwise direction for scanning the LCD panel from top to bottom with light beam 42. As shown in dotted line form in FIG. 8, the light beam focusing element may take the form of an elliptically shaped reflector 40 for directing the light beam on reflector 36 and focusing the beam on LCD panel 30**.

Figure 10:
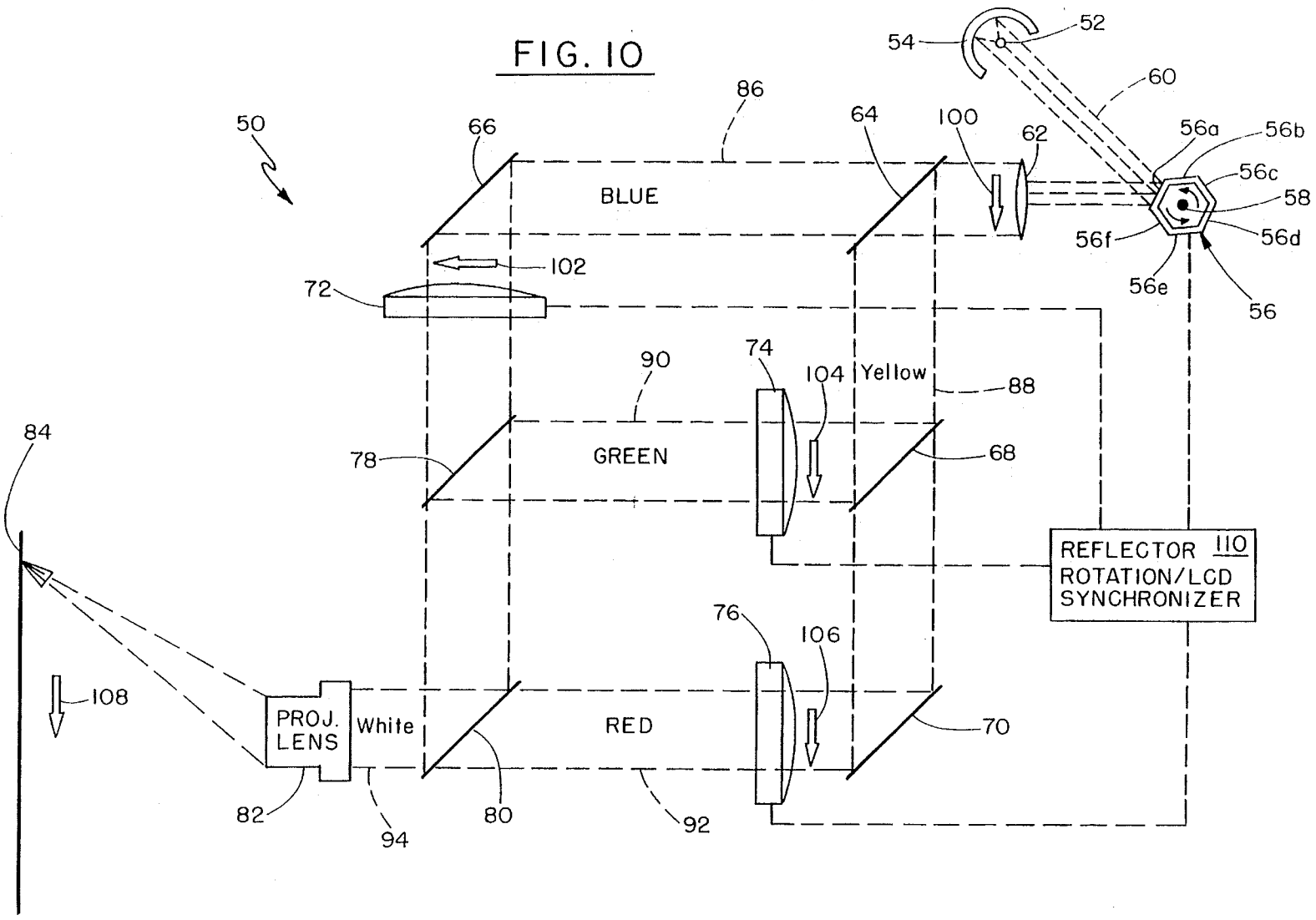
FIG. 10 is a simplified schematic diagram illustrating another embodiment of a projection LCD display system and backlighting arrangement in accordance with the present invention.

Referring to FIG. 10, there is shown a simplified schematic diagram of another embodiment of a projection LCD display system 50 incorporating a backlighting arrangement in accordance with the present invention. As in the previously described embodiment, the backlighting arrangement includes an elongated, linear light source 52 disposed generally within a concave light focusing element 54 which directs a light beam 60 onto a rotating, multi-faceted reflector 56. Reflector 56 is rotated counterclockwise as shown by the direction of the arrows in the figure about an axis of rotation 58 and includes a plurality of planar reflecting surfaces **56*a*–56*f*. Light beam 60 is directed by rotating reflector 56 onto a projection LCD display arrangement which includes a lens system 62 which is shown only as a single lens for simplicity, but typically includes various combinations of lenses through which the light beam is directed. With the multi-faceted reflector 56 rotated counterclockwise, light beam 60 is displaced over the lens system 62 in the direction of arrow 100 in the figure. The projection LCD display system 50 includes a first dichroic mirror 64 which reflects a yellow light beam 88 while transmitting a blue light beam 86 onto a first flat reflecting mirror 66. The first flat mirror 66 reflects the blue light beam 86 onto a first LCD panel 72. The blue light beam 86 is swept across the first LCD panel 72 in the direction of arrow 102, with a blue image projected from the first LCD panel through a third dichroic mirror 78 and onto a fourth dichroic mirror 80. The blue light beam 86 is swept across the surface of the first LCD panel 72 synchronously with the actuation and rendering transparent of the LCD panel's scanning electrode arrays as previously described, which electrode arrays are not shown in the figure for simplicity. This is accomplished by means of a reflector rotation/LCD synchronizer 110 which is coupled to reflector 56 and first LCD panel 72 for synchronizing rotation of the reflector with the scanning of the electrode arrays of the first LCD panel as described above in the previously discussed embodiments. Reflector rotation/LCD synchronizer 110 is further coupled to second and third LCD panels 74 and 76 (which are described below) for synchronizing the scanning of their respective arrays of scanning electrodes with rotation of reflector 56** in a similar manner.

The first dichroic mirror 64 directs the yellow beam 88 onto a second dichroic mirror 68 which separates the beam onto a green beam 90 and a red beam 92 which is directed onto a second flat reflecting mirror 70. The second dichroic mirror 68 directs the green beam 90 onto a second LCD panel 74. The green beam 90 is displaced across the second LCD panel 74 in the direction of arrow 104 synchronously with actuation of the LCD panel's scanning electrode arrays to provide a green image which is directed onto the third dichroic mirror 78. The green image is reflected by the third dichroic mirror 78 onto the fourth dichroic mirror 80.

With the second dichroic mirror 68 transmitting a red beam 92 onto the second flat reflecting mirror 70, the red beam 92 is then directed onto a third LCD panel 76. The red beam is swept across the third LCD panel 76 in the direction of arrow 106 because of the counter-clockwise rotation of the multi-faceted reflector 56. Displacement of the red beam 92 over the third LCD panel 76 is synchronous with the actuation and rendering transparent of the LCD panel's scanning electrode arrays. A red image is provided by the third LCD panel 76 and is directed onto the fourth dichroic mirror 80.

The fourth dichroic mirror 80 transmits the red image and reflects the blue and green images to form a white beam 94 containing the full spectrum of colors. The white beam 94 is directed onto a projection lens 82 which focuses the image on a projection screen 84. The counter-clockwise rotation of the multi-faceted reflector 56 and the manner in which each of the individual color beams is scanned across a respective LCD panel causes the multi-color video image to be scanned across projection screen 84 in the direction of arrow 108. The first and second dichroic mirrors 64 and 68 perform a color separation function, while the third and fourth dichroic mirrors 78 and 80 perform a color beam recombining function to form a multi-colored image which is focused by projection lens 82 on the projection screen 84. By backlighting only those portions of each of the three LCD panels 72, 74 and 76 which are transparent and thus provide a portion of the video image, video image contrast is improved and backlighting efficiency is increased.

There has thus been shown a backlighting arrangement for a liquid crystal display (LCD) panel employing an elongated, linear lamp disposed within a first concave reflector for focusing and directing the beam onto a second reflector which reflects the beam on the aft surface of the LCD panel. The second reflector displaces the beam over the display panel in a scanning manner vertically from top to bottom synchronously with scanning of the LCD panel's horizontally aligned conductive scanning electrodes such that the light beam only illuminates the horizontal linear array of scanning electrodes which is turned ON, i.e., only that portion of the display panel containing video information, for improved video image contrast and more efficient backlighting of the display panel. The second reflector in the disclosed embodiment is comprised of a multi-faceted rotating reflector, the speed of which is synchronized with the scanning speed of the LCD panel's scanning electrodes.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A video display apparatus comprising:

a passive, generally planar display panel having a plurality of linear, spaced, parallel arrays of video image elements, wherein said arrays of video image elements are vertically scanned in a sequential manner from a first edge of said panel to a second, opposed edge of said panel in providing a plurality of spaced, parallel portions of a video image in a sequential manner on said display panel;

an elongated, generally linear light source for providing an elongated, linear light beam focused on said display panel and having uniform intensity along the length thereof;

reflecting means for receiving and directing said focused light beam onto said display panel in a scanning manner, wherein said light beam traverses said display panel from the first edge to the second edge thereof, said reflecting means including a rotating mirror having a plurality of spaced reflecting surfaces disposed about an outer periphery thereof, wherein said mirror is rotated about an axis generally parallel to said planar display panel; and synchronizing drive means coupled to said display panel and to said reflecting means for displacing said light beam across said display panel from the first edge to the second edge thereof in synchronism with the vertical scanning of said arrays of video image elements in said display panel in providing a video image on said display panel such that only that portion of said display panel providing a portion of a video image is illuminated by said light beam at a given time.

2. The apparatus of claim 1 wherein said display panel is a liquid crystal display.

3. The apparatus of claim 1 wherein said light source includes an elongated, generally linear lamp for emitting uniform, high intensity light and a concave reflector disposed adjacent to and partially about said lamp for directing the light onto said reflecting means and focusing the light on said display panel.

4. The apparatus of claim 3 wherein said concave reflector has a focal axis, and wherein said lamp is disposed on said focal axis for focusing the beam on said display panel.

5. The apparatus of claim 4 wherein said concave reflector has a generally circular inner reflecting surface and means defining an elongated, linear slot extending the length thereof, and wherein said inner surface is in facing relation to said lamp and said slot is disposed in facing relation to said reflecting means.

6. The apparatus of claim 4 wherein said concave reflector has a generally elliptical inner reflecting surface and means defining an elongated, linear slot extending the length thereof, and wherein said inner surface is in facing relation to said lamp and said slot is disposed in facing relation to said reflecting means.

7. The apparatus of claim 1 wherein said light source is a Xenon arc lamp.

8. The apparatus of claim 1 wherein said light source is a metal halide lamp.

9. The apparatus of claim 1 wherein said mirror is rotated at a fixed angular velocity for scanning the display panel with said light bean in a continuous manner.

10. The apparatus of claim 9 wherein the first edge of said display panel is at an upper portion thereof and the second edge of said display panel is at a lower portion thereof, and wherein said light beam scans said display panel from top to bottom.

11. The apparatus of claim 1 wherein said synchronizing drive means displaces said light beam in a continuous manner at a constant speed over said display panel.

12. The apparatus of claim 2 further comprising a projection screen disposed adjacent to and aligned with said display panel for displaying a video image on said projection screen.

13. A video display apparatus comprising:

a passive, generally planar display panel having a plurality of aligned, linear arrays of electrodes arranged in a spaced manner between a first edge of said panel and a second, opposed edge of said panel, wherein each array of electrodes is rendered conductive in a sequential manner from the first edge to the second edge of said display panel, with a conductive array of electrodes further rendered transparent for transmitting light from a first side of said panel to a second, opposed side of said panel;

an elongated light source aligned generally parallel with the first and second edges of said display panel for providing a thin, elongated, generally linear light beam having uniform intensity along the length thereof;

focusing means for focusing said light beam on the first side of said display panel to a thin line;

reflecting means disposed intermediate said light source and said display panel along said light beam for displacing said light beam over said display panel in a scanning manner from the first edge to the second edge of said display panel, said reflecting means including a rotating mirror having a plurality of spaced reflecting surfaces disposed about an outer periphery thereof, wherein said mirror is rotated about an axis generally parallel to said planar display panel; and synchronizing means coupled to said display panel and said reflecting means for displacing said light beam over said display panel from the first edge to the second edge thereof synchronously with the sequential rendering conductive of said arrays of electrodes for illuminating only that array of electrodes which is transparent at a given time with said light beam.

* * * * *